US006647957B1

(12) United States Patent
Cha

(10) Patent No.: US 6,647,957 B1
(45) Date of Patent: Nov. 18, 2003

(54) FUEL CONTROL VALVE FOR PREVENTING SUDDEN START OF AUTOMOBILE

(76) Inventor: Yong Won Cha, 592-10, Pajang-dong, Jangan-ku, Suwon, Kyungki-do 440-290 (KR)

( * ) Notice: Subject to any disclaimer, the term of this patent is extended or adjusted under 35 U.S.C. 154(b) by 0 days.

(21) Appl. No.: 10/019,115

(22) PCT Filed: Jun. 22, 2000

(86) PCT No.: PCT/KR00/00659

§ 371 (c)(1),
(2), (4) Date: May 1, 2002

(87) PCT Pub. No.: WO00/79119

PCT Pub. Date: Dec. 28, 2000

(30) Foreign Application Priority Data

Jun. 23, 1999 (KR) ..... 1999/23724

(51) Int. Cl.[7] ..... F02D 31/00
(52) U.S. Cl. ..... 123/359; 123/514; 123/198 D
(58) Field of Search ..... 123/198 D, 198 DB, 123/514, 458, 179.17, 359

(56) References Cited

U.S. PATENT DOCUMENTS

| | | | | |
|---|---|---|---|---|
| 4,361,121 A | * | 11/1982 | Clemens et al. | 123/198 DB |
| 4,369,750 A | * | 1/1983 | Muntean et al. | 123/505 |
| 4,515,125 A | * | 5/1985 | Buck et al. | 123/359 |
| 4,791,900 A | * | 12/1988 | Buck et al. | 123/359 |
| 4,895,116 A | * | 1/1990 | Haydu | 123/198 D |

FOREIGN PATENT DOCUMENTS

| | | |
|---|---|---|
| JP | 1178029 | 7/1989 |
| JP | 4166661 | 6/1992 |
| KR | 1998-035489 A | 8/1998 |
| KR | 1998-038658 A | 8/1998 |

* cited by examiner

*Primary Examiner*—Carl S. Miller
(74) *Attorney, Agent, or Firm*—Patton Boggs LLP

(57) ABSTRACT

Described herein is a fuel feeding apparatus for an automobile including a fuel tank, an engine supplied with a fuel from the fuel tank by a fuel pump through a fuel feeding pipe, and a fuel return pipe for returning overflow fuel to the fuel tank. The apparatus comprises a fuel control valve, located at the proper position in an engine, for controlling the amount of fuel; fuel inlet and outlet pipes provided in the fuel control valve; a main fuel feeding line for feeding the fuel to the engine through the fuel inlet and outlet pipes; an auxiliary fuel feeding line connected parallel to the main fuel feeding line; a solenoid valve for controlling the supply of the fuel of the main fuel feeding line according to a detected signal of a brake switch provided on the brake pedal; and an auxiliary fuel control valve having a fuel control screw for controlling the fuel; the auxiliary fuel feeding line including a check valve for opening/closing a bypass pipe according to the pressure of the auxiliary fuel feeding line, the bypass pipe returning the residual fuel to the fuel tank; the main fuel feeding line including on its lower end a pressure sensitive switch operated according to a predetermined pressure when the pressure in the line is fluctuates due to an exterior affect on the engine.

8 Claims, 4 Drawing Sheets

FUEL CONTROL VALVE FOR PREVENTING SUDDEN START OF AUTOMOBILE

TECHNICAL FIELD

The present invention relates to a fuel control valve for preventing the sudden acceleration of an automobile.

BACKGROUND ART

Generally, a throttle valve for controlling the amount of intake air is operated by an accelerator. If the throttle valve is opened by the accelerator, fuel is supplied with the air into an engine room.

If the throttle valve is excessively opened due to the inexperience or mistake of a driver or an exterior influence, a lot of fuel mixed with the air is supplied into the engine, resulting in the sudden increase of the output of the engine and leading to sudden acceleration.

When parking, if an object or a person is in front or behind the automobile, an accident could easily occur.

DISCLOSURE OF THE INVENTION

It is an object of the present invention to solve the problems involved in the related art, and to provide a fuel feeding apparatus including a fuel control valve, located in the proper position in an engine, for controlling the amount of a fuel, whereby the sudden acceleration of the automobile due to unknown reasons or the inexperience or mistake of the driver, is prevented.

It is another object of the present invention to provide a fuel feeding apparatus capable of notifying a driver of the possibility of the sudden acceleration in time by operating an alarm sound and an alarm lamp.

In order to achieve the above objects, there is provided a fuel feeding apparatus for an automobile including a fuel tank, an engine supplied with fuel from a fuel tank by a fuel pump through a fuel feeding pipe, and a fuel return pipe for returning overflowed fuel to the fuel tank, the apparatus comprising: a fuel control valve, positioned in the proper position in the engine, for controlling the amount of fuel; a fuel inlet and outlet pipes provided in the fuel control valve; a main fuel feeding line for feeding the fuel to the engine through the fuel inlet and outlet pipes; an auxiliary fuel feeding line connected parallel to the main fuel feeding line; a solenoid valve for controlling the supply of the fuel of the main fuel feeding line according to a detected signal of a brake switch provided on a brake pedal; and an auxiliary fuel control valve having a fuel control screw for controlling the fuel; the auxiliary fuel feeding line including a check valve for opening/closing a bypass pipe according to the pressure of the auxiliary fuel feeding line, a bypass pipe returning residual fuel to the fuel tank; a main fuel feeding line including at its lower end a pressure sensitive switch operated according to a predetermined pressure when the pressure in the line fluctuates due to an exterior affect on the engine.

Preferably, signals of the brake and pressure sensitive switches are transmitted to a delay timer, and the delay timer operates an alarm sound, an alarm lamp, and a solenoid valve after a predetermined time.

The fuel control valve is provided on the upstream with a solenoid valve that prevents the increase of flow rate of the fuel passing through the fuel outlet pipe according to the pressure fluctuation in the fuel control valve when the engine is started and prevents a delayed starting phenomenon from happening due to a possible temporary fuel shortage, after excessive fuel flows in when the sudden acceleration mode is released and the engine is restarted.

According to the present invention, since the fuel feeding apparatus includes a fuel control valve, provided at a proper position in the engine, for controlling the amount of fuel, a sudden acceleration of the automobile due to unknown reasons or the inexperience or mistake of the driver or an exterior influence can be prevented.

Also, the driver is notified of the possibility of the sudden acceleration in time by the operation of an alarm sound and an alarm lamp.

BRIEF DESCRIPTION OF THE DRAWINGS

The other features and advantages of the present invention will become more apparent by describing the preferred embodiment thereof with reference to the accompanying drawings, in which:

FIG. 2 is a view illustrating the operating state of the fuel control valve according to the present invention, wherein

Figure 1:
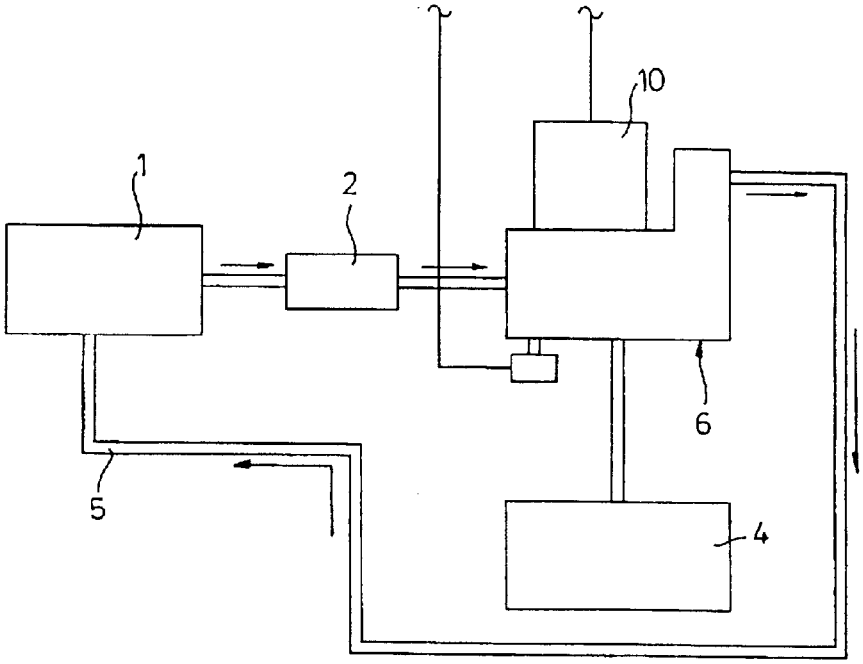
FIG. 1 is a perspective view illustrating the construction of the fuel control valve according to the present invention.

Best Mode for Carrying Out the Invention

Now, the preferred embodiment of the present invention will be described in detail with reference to the annexed drawings.

A fuel feeding apparatus for an automobile comprises a fuel tank 1, an engine 4 fed with fuel from the fuel tank 1 by a fuel pump 2 through a fuel feeding pipe 3, and a fuel return pipe 5 for returning fuel overflow to the fuel tank 1.

The fuel feeding apparatus further comprises a fuel control valve 6, positioned at a proper position in engine, for controlling the amount of fuel, fuel inlet and outlet pipes 6*a* and 6*b* in the fuel control valve 6, a main fuel feeding line 7 for feeding the fuel to the engine 4 through the fuel inlet and outlet pipes 6*a* and 6*b*, and an auxiliary fuel feeding line 8 in parallel with the main fuel feeding line 7.

The auxiliary fuel feeding line 8 is connected to the main fuel feeding line 7, and comprises a solenoid valve 10 for controlling the supply of the fuel through the main fuel feeding line 7 according to the detected signal of a brake switch 9 provided on a brake pedal (not shown). If the solenoid valve 10 is operated by the detected signal of the brake switch 9 to close a fuel inlet 7*a* of the main fuel feeding line 7, the fuel is fed to the engine 4 through the auxiliary fuel feeding line 8.

The auxiliary fuel feeding line 8 includes an auxiliary fuel control valve 11 having a fuel control screw 11*a* for controlling the fuel.

Also, the auxiliary fuel feeding line 8 includes a check valve 13 having a pressure control screw 13*a* which is opened/closed according to the pressure of the auxiliary fuel feeding line 8. With the operation of the check valve 13, the fuel is returned to the fuel tank 1 through a bypass pipe 12 connected to the fuel return pipe 5.

The main fuel feeding line 7 includes on its lower end a pressure sensitive switch 14 that is operated according to the pressure fluctuation of the line.

The signal of the pressure sensitive switch 14 is inputted to a delay timer 15 in the alarm circuit, and after a predetermined time has lapsed, an alarm sound 16, an alarm lamp 17, and a power on/off switch 19 are activated.

The fuel control valve 6 includes a solenoid valve 20 that prevents the increase of the flow rate of the fuel passing through the fuel outlet pipe 6*b* according to the pressure fluctuation in the fuel control valve 6 on starting and also prevents the delayed starting phenomenon from arising due to the temporary fuel shortage after the left over fuel flows in.

The operation and working effect of the present invention as shown above will now be described in detail.

Figure 2A:
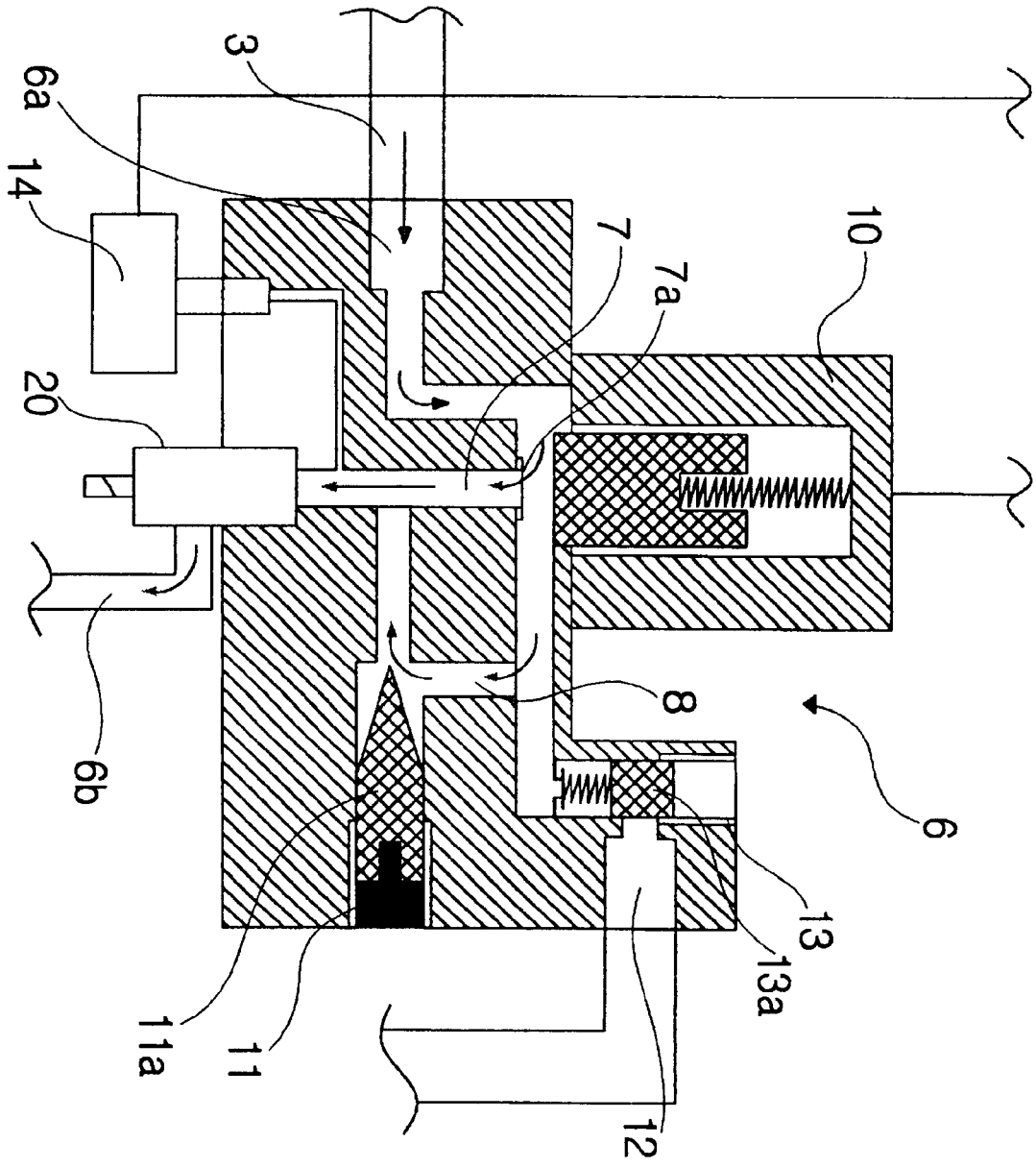
FIG. 2*a* shows a state where an automobile is driven in a normal state.

When the automobile is operated normally as shown in FIGS.1 and 2*a*, the fuel flows into the fuel inlet pipe 6*a* of the fuel control valve 6 located in the proper position of the fuel feeding pipe 3. And, the fuel flows into the main fuel feeding line 7, and simultaneously flows into the auxiliary fuel feeding line 8 connected parallel to the main fuel feeding line 7.

At that time, since the lower end of the main fuel feeding line 7 is connected to the auxiliary fuel feeding line 8, the fuel is supplied to the engine 4 through the main and auxiliary fuel feeding lines 7 and 8.

Figure 2B:
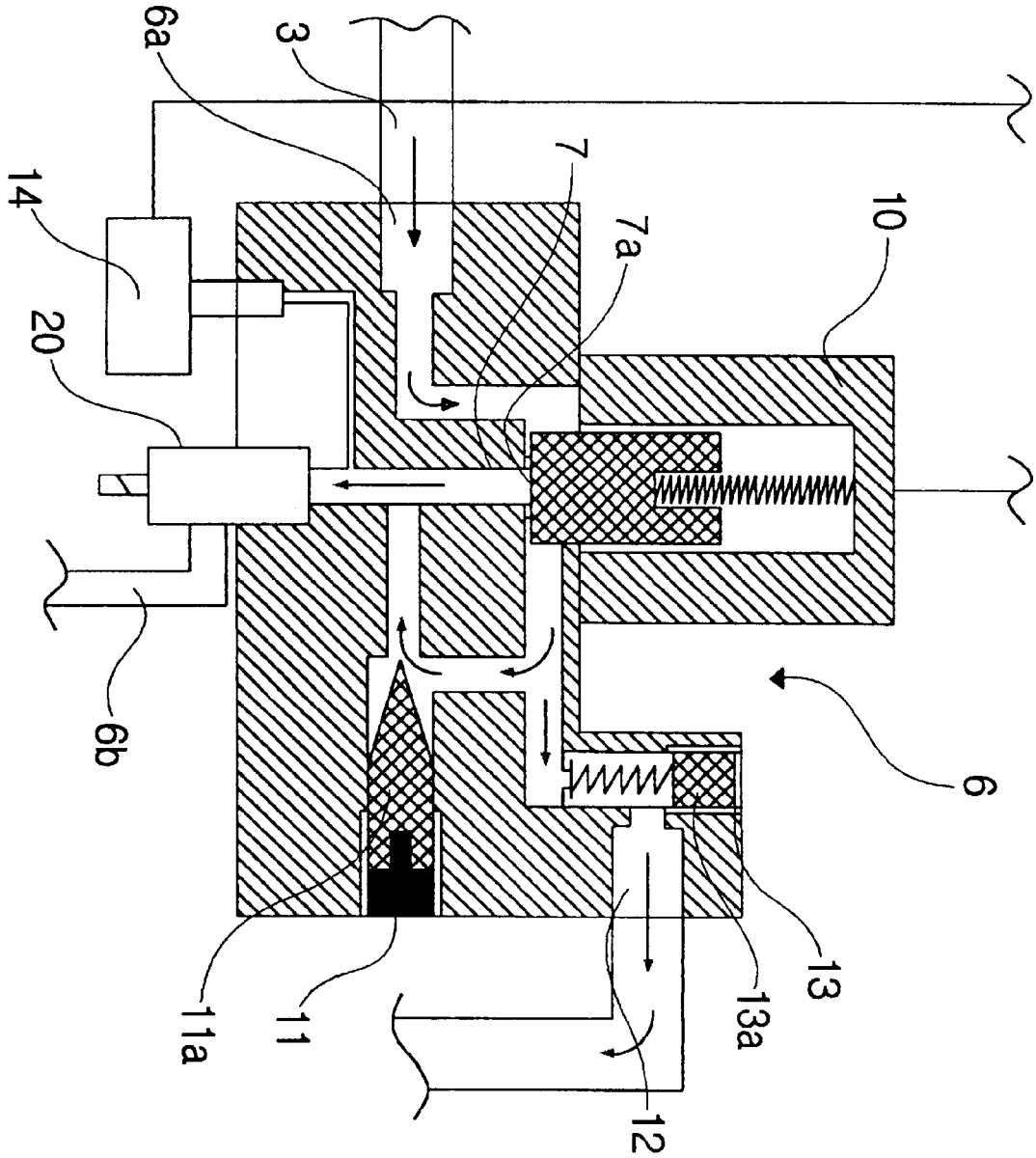
FIG. 2*b* shows the state where the accelerator is operated.

As shown in FIG. 2*b*, if a driver pedals the brake (not shown), since the brake switch detecting the operation of the brake is connected with the solenoid valve 10 provided on the upper end of the main fuel feeding line 7, the solenoid valve 10 controls the open/close of the fuel inlet 7*a* of the main fuel feeding line 7 according to the detected signal from the brake switch 9.

At that time, the fuel is supplied to the engine 4 only through the auxiliary fuel feeding line 8. Since the auxiliary fuel control valve 11 containing the fuel control screw 11*a* for controlling the fuel to be supplied to the auxiliary fuel feeding line 8 is connected to the auxiliary fuel feeding line 8, a small amount of fuel can be supplied to the engine 4 to reduce the output of the engine.

In order to close the main fuel feeding line 7 by using the solenoid valve 10 and to prevent the overload of the fuel pump 2 when the fuel is supplied to the auxiliary fuel feeding line 8, the fuel control valve 6 is provided with the bypass pipe 12 connected to the return pipe 5 for returning the residual fuel to fuel tank 1.

At that time, since the bypass pipe 12 is connected to the check valve 13 having a pressure control screw 13*a* for controlling the pressure of the auxiliary fuel feeding line 8, the residual fuel flows to the fuel return pipe 5 through the bypass pipe 12 by way of the check valve 13.

With this construction, even though the engine is overloaded, the output of the engine may be decreased by reducing the amount of the fuel supplied. Also, even though the driver pushes the accelerator as well as the brake, the output of the engine is not increased thereby preventing the sudden acceleration of the automobile.

By contrast, if the driver pushes the accelerator to increase the output of the engine, and then pedals the brake, the output of the engine is promptly decreased.

In a state where the driver pedals the brake, the fuel is supplied to the engine only through the auxiliary fuel feeding line 8, thereby preventing an abnormally high output of the engine.

Figure 3:
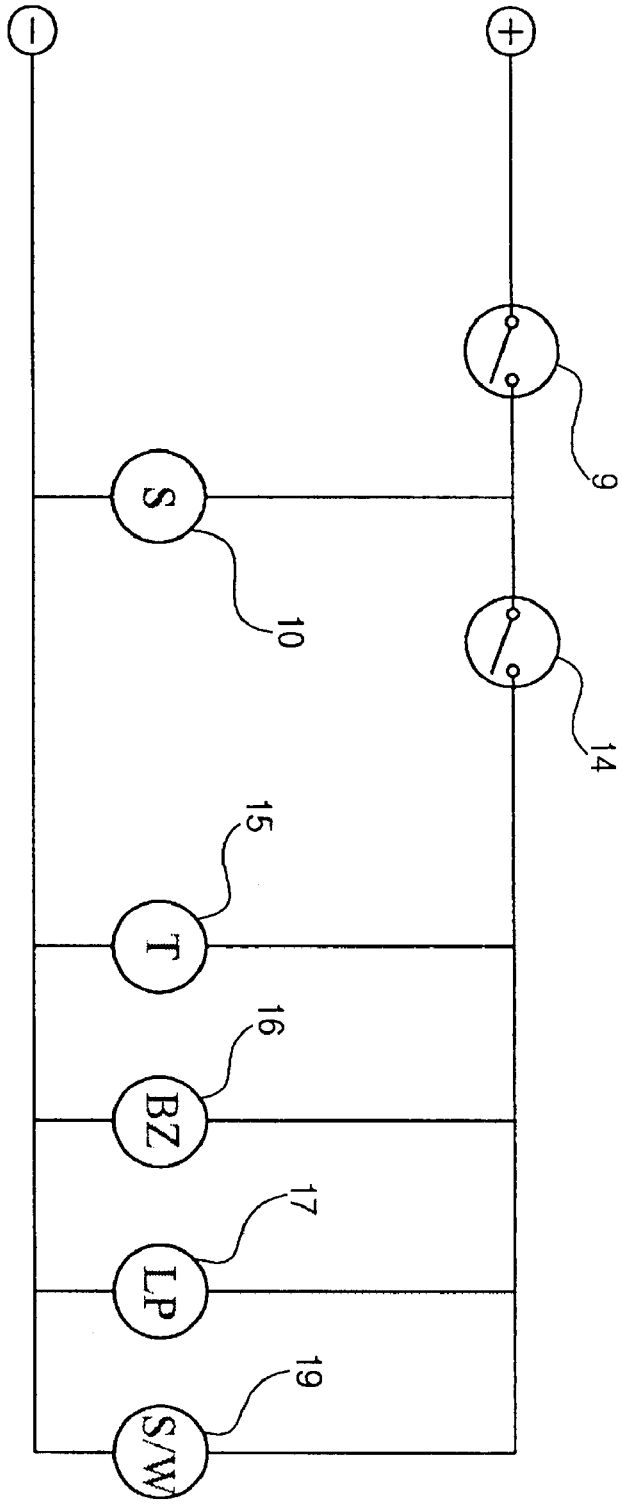
FIG. 3 is a circuit diagram of an alarm circuit of a fuel control valve according to the present invention

As shown in FIG. 3, since the main fuel feeding line 7 is provided on its lower end with a pressure sensitive switch 14 that is operated according to the pressure fluctuation of the line, the pressure sensitive switch 14 detects the high output of the engine 4 (the throttle valve is excessively opened by not operating the accelerator), when the brake is released.

The detecting operation of the pressure sensitive switch is described as follows. If the throttle valve is opened excessively, the main fuel feeding line 7 is closed by pedaling the brake, and a small quantity of fuel is supplied to the engine through the auxiliary fuel feeding line 8. The switch can detect the pressure fluctuation in the auxiliary fuel feeding line 8 and the fuel outlet pipe 6*b*. The detected signal is transmitted to the delay timer 15 of the alarm circuit. After a predetermined time, the timer 15 operates the alarm sound 16 and the alarm lamp 17, so that the driver can take note of the possibility of the sudden acceleration at time that the brake is released.

At that time, the timer 15 operates the power on/off switch 19 to stop the engine after a predetermined time, thereby preventing the sudden acceleration at an early stage.

The fuel control valve 6 is provided in the upstream with the solenoid valve 20 that prevents the increase of the flow rate of the fuel passing through the fuel outlet pipe 6*b* determined by the pressure fluctuation in the fuel control valve 6 on starting and also prevents the delayed starting phenomenon from occuring due to a temporary fuel shortage after the overflow fuel flows in.

Since the engine may be at a state of high output temporarily when the driver pedals the brake, after the delay timer operates, the alarm sound 16, the alarm lamp 17, and the power on/off switch 19 operate to determine the temporarily high output.

The fuel control valve 6 is provided on the upstream with a check valve operated by a spring, the check valve preventing the increase of the flow rate of the fuel passing through the fuel outlet pipe 6*b* according to the pressure fluctuation in the fuel control valve 6 when the engine is started, and preventing a delayed starting phenomenon from occuring due to a temporary fuel shortage after the excessive fuel flows in when the sudden acceleration mode is released and the engine is restarted.

INDUSTRIAL APPLICABILITY

As is apparent from the above description, since the fuel feeding apparatus includes a fuel control valve, provided at a proper position in the engine, for controlling the amount of fuel, sudden acceleration of the automobile due to unknown reasons or the inexperience or mistake of the driver or an exterior influence may be prevented.

Also, the driver is notified of the possibility of the sudden acceleration in time by the operation of an alarm sound and an alarm lamp.

What is claimed is:

1. A fuel feeding apparatus for an automobile including a fuel tank, an engine supplied with fuel from the fuel tank by a fuel pump through a fuel feeding pipe, and a fuel return pipe for returning overflowed fuel to the fuel tank, the apparatus comprising:

a fuel control valve, positioned in the proper position in the engine, for controlling the amount of fuel;

fuel inlet and outlet pipes provided in the fuel control valve;

a main fuel feeding line for feeding the fuel to the engine through the fuel inlet and outlet pipes;

an auxiliary fuel feeding line connected parallel to the main fuel feeding line;

a solenoid valve for controlling the supply of the fuel of the main fuel feeding line according to a detected signal of a brake switch located on a brake pedal; and an auxiliary fuel control valve having a fuel control screw for controlling the fuel;

an auxiliary fuel feeding line including a check valve for opening/closing a bypass pipe according to the pressure of the auxiliary fuel feeding line, the bypass pipe returning residual fuel to the fuel tank; and the main fuel feeding line including on its lower end a pressure sensitive switch operated according to a predetermined pressure level when the pressure in the line fluctuates due to an exterior affect on the engine.

2. The apparatus as claimed in claim 1, wherein the fuel control valve is located on its upstream with a solenoid valve that prevents the increase of the flow rate of the fuel passing through the fuel outlet pipe according to the pressure fluctuation in the fuel control valve when the engine is started and which prevents a delayed starting phenomenon from occurring due to a temporary fuel shortage after the excessive fuel flows in when the sudden acceleration mode is released and the engine is restarted.

3. The apparatus as claimed in claim 1, wherein signals of the brake and pressure sensitive switches are transmitted to a delay timer, and the delay timer operates an alarm sound, an alarm lamp, and a solenoid valve after a predetermined time.

4. The apparatus as claimed in claim 1, wherein the delay timer operates a power on/off switch to stop the engine after a predetermined time.

5. The apparatus as claimed in claim 1, wherein the fuel control valve is provided on its upstream with a check valve operated by a spring, the check valve preventing the increase of the flow rate of the fuel passing through the fuel outlet pipe according to the pressure fluctuation in the fuel control valve when the engine is started, which prevents a delayed starting phenomenon from occurring due to a temporary fuel shortage after excessive fuel flows in when the sudden acceleration mode is released and the engine is restarted.

6. The apparatus as claimed in claim 2, wherein signals of the brake and pressure sensitive switches are transmitted to a delay timer, and the delay timer operates an alarm sound, an alarm lamp, and a solenoid valve after a predetermined time.

7. The apparatus as claimed in claim 2, wherein the delay timer operates a power on/off switch to stop the engine after a predetermined time.

8. The apparatus as claimed in claim 2, wherein the fuel control valve is provided on its upstream with a check valve operated by a spring, the check valve preventing the increase of the flow rate of the fuel passing through the fuel outlet pipe according to the pressure fluctuation in the fuel control valve when the engine is started, which prevents a delayed starting phenomenon from occurring due to a temporary fuel shortage after excessive fuel flows in when the sudden acceleration mode is released and the engine is restarted.

* * * * *